US006347756B1

(12) United States Patent
Dillard

(10) Patent No.: US 6,347,756 B1
(45) Date of Patent: Feb. 19, 2002

(54) CANDLE FORMING KIT

(76) Inventor: Virgie L. Dillard, 901 SW. Sally Cir., Lee's Summit, MO (US) 64081

( * ) Notice: Subject to any disclaimer, the term of this patent is extended or adjusted under 35 U.S.C. 154(b) by 0 days.

(21) Appl. No.: 09/656,693

(22) Filed: Sep. 7, 2000

(51) Int. Cl.[7] ..... B02C 19/12
(52) U.S. Cl. ..... 241/101.2; 241/199.11; 241/283
(58) Field of Search ..... 241/101.2, 199.11, 241/283, 270

(56) References Cited

U.S. PATENT DOCUMENTS

| | | | | |
|---|---|---|---|---|
| 4,117,980 A | * | 10/1978 | Hartmann | 241/199.11 |
| 4,826,428 A | | 5/1989 | Lam | |
| 4,855,098 A | | 8/1989 | Taylor | |
| 5,605,765 A | | 2/1997 | Rudick | |
| 5,654,016 A | | 8/1997 | Shell | |
| 5,875,555 A | | 3/1999 | Andrisin, III et al. | |
| 5,910,005 A | | 6/1999 | Scherr | |
| 5,927,965 A | | 7/1999 | Pappas | |
| 5,988,446 A | | 11/1999 | Schitter | |
| 6,053,217 A | | 4/2000 | Schuh | |

* cited by examiner

*Primary Examiner*—Mark Rosenbaum
(74) *Attorney, Agent, or Firm*—Dale J. Ream

(57) ABSTRACT

A candle forming kit comprises a container having a cylindrical side wall, a closed bottom, and an open top. A lid is threadably coupled to said side wall so as to cover the open top. The kit includes a shaft extending through the lid and adapted to rotate about an imaginary vertical axis extending longitudinally through the container. A first end of the shaft extends upwardly through the lid and is threadably coupled to a cylindrical handle member. A second end of the shaft is disposed within the container and includes a plurality of axially spaced apart chopper blades. The shaft is also coupled to a compression spring mounted within the lid. Placement of downward pressure by a user on the handle member biases the spring and positions the chopper blades substantially adjacent the bottom wall of the container. An upward pressure on the handle member, or merely removing the downward pressure, causes the spring to return to its normally unbiased configuration and thus lifts the shaft and raises the chopper blades to a position adjacent the spring. The kit includes blade assemblies, each assembly having a particular type of blade connected to a cap member that is adapted to be threadably coupled to an open end of the handle member.

19 Claims, 5 Drawing Sheets

CANDLE FORMING KIT

BACKGROUND OF THE INVENTION

The present invention relates generally to candle making devices and, more particularly, to a candle forming kit having a wax chopping container with a plurality of wax manipulation tool attachments.

A significant problem experienced when burning candles is that only the core of a wax candle burns along with the wick, thus leaving a significant amount of unused wax. Continuously discarding used candles having a large amount of unused wax and purchasing new candles is an unfortunate expense and unnecessary frustration experienced by persons who frequently enjoy burning candles.

Several devices have been proposed in the art for reusing the wax of previously burned candles to form new candles. While assumably effective for their intended purposes, existing devices do not conveniently provide all of the necessary wax manipulation tools wherewith to extract old wax from candle containers and process it into a reusable form.

Therefore, it is desirable to have a candle forming kit which is useful wherewith to scrape old wax from a previously used candle container, to cut the extracted wax into smaller portions, to chop the cut wax into even smaller portions, and to mash or tamp the chopped wax into a new container so as to form a new candle. Further, it is desirable to have a candle forming kit in which a handle member of a chopping container is removable from the container and independently useful as a handle for a plurality of blade assemblies.

SUMMARY OF THE INVENTION

A kit for forming candles according to a preferred embodiment of the present invention includes a container having a cylindrical side wall, a bottom wall 13, and an open top. A lid is threadably coupled to the side wall so as to releasably cover the open top. The lid is releasably attached so that chunks of wax may be deposited within the container as wax is extracted from previously burned candles. Further, a shaft is positioned in said container for rotation about an imaginary vertical axis extending longitudinally through the container. The shaft includes a threaded first end which extends upwardly through the lid and includes a second end disposed within the container itself and having a plurality of chopper blades axially spaced about the second end. The first end of the shaft is threadably coupled to a cylindrical handle member.

The kit further includes a compression spring mounted within the lid that is coupled to the shaft. The spring is biased and the shaft is moved downwardly upon a downward pressure by a user upon the handle member. Conversely, the spring becomes unbiased and the shaft is moved upwardly upon an upward pressure upon the handle member, or merely by applying no pressure at all to the handle member. At a biased configuration, the chopper blades are substantially adjacent the bottom wall of the container, while the blades are adjacent the spring when the spring is in its unbiased configuration. Repeated up/down movements of the handle member allow the chopper blades to chop wax deposited in the container into small pieces or crumbs. The handle member may also be rotated while the spring is biased so as to mix the deposited wax.

The cylindrical handle member defines opposed open ends, each open end being threaded. The kit further includes a plurality of blade assemblies, each assembly having a particular blade configuration coupled to a cap member with a rod and each assembly is adapted for a particular type of wax manipulation. A tamping device is also provided and able to be threadably coupled to an open end.

Therefore, a general object of this invention is to provide a candle forming kit in which unused wax from previously burned candles may be extracted and processed for reuse in a newly formed candle.

Another object of this invention is to provide a candle forming kit, as aforesaid, in which candles may be made easily and affordably using previously burned candles.

Still another object of this invention is to provide a candle forming kit, as aforesaid, which can cut, pry, scrape, and shred wax from a previously burned candle.

A further object of this invention is to provide a candle forming kit, as aforesaid, which can chop large chunks of wax into much smaller pieces or crumbs.

A still further object of this invention is to provide a candle forming kit, as aforesaid, in which the handle of a chopper assembly may be utilized independently as a handle for a variety of other wax manipulating tools.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

A candle forming kit according to a preferred embodiment of the present invention will now be described with reference to FIGS. 1 through 5 of the accompanying drawings.

Figure 4A:
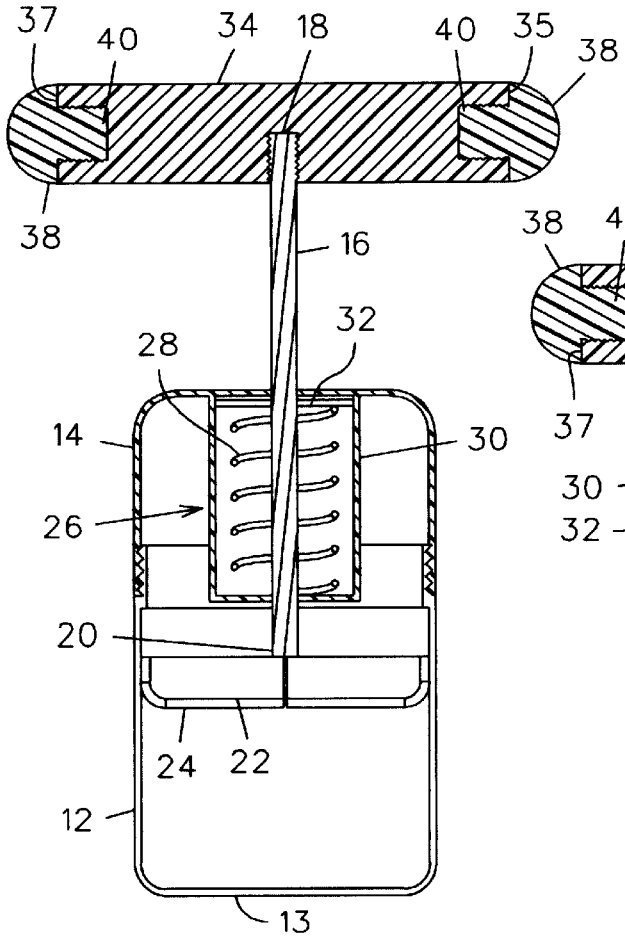
FIG. 4*a* is a sectional view of the chopper assembly taken along line 4—4 of FIG. 1 in an unbiased configuration.

The candle forming kit includes a chopper assembly 10. The chopper assembly 10 comprises a container that includes a body portion 12 having a cylindrical side wall integrally attached to a closed bottom and defining an open top. The body portion 12 is constructed of a durable plastic material that is transparent although a glass jar construction would also be suitable. The chopper assembly 10 further includes a lid 14 releasably coupled to the body portion 12 which is selectively removable therefrom such that wax may be deposited therein as desired. The outer surface of the side wall of the body portion 12 and the inner surface of the lid 14 include threads complementary to each other such that the lid 14 may be threadably coupled to the body portion 12 (FIG. 4*a*). The lid 14 defines a circular aperture through a center point of a top thereof.

The chopper assembly 10 further includes an elongate shaft 16 which extends through the aperture in the lid 14 and longitudinally within the body portion 12. The shaft is rotatable about an imaginary vertical axis which extends longitudinally through the center of the chopper assembly 10. The shaft 16 includes a first threaded end 18 which extends above the lid 14 and a second end 20 disposed within the body portion 12. A plurality of chopper blades 22 are fixedly attached to the second end 20 and are axially spaced thereabout. Each chopper blade 22 is normal to the shaft and extends substantially between the shaft and the side wall of the body portion 12. In addition, each chopper blade 22 includes a sharpened bottom edge 24 for chopping wax deposited in the body portion 12, as to be further described below.

Figure 4B:
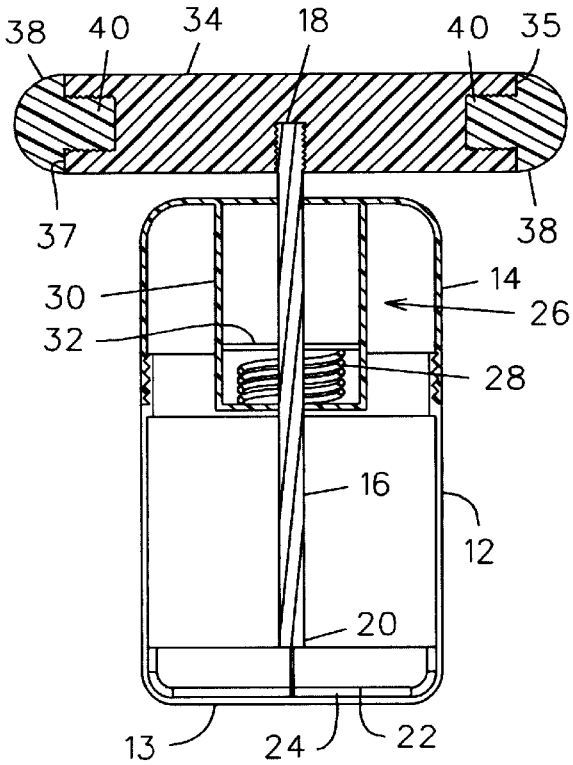
FIG. 4*b* is a sectional view of the chopper assembly taken along line 4—4 of FIG. 1 in a biased configuration.
Figure 5:
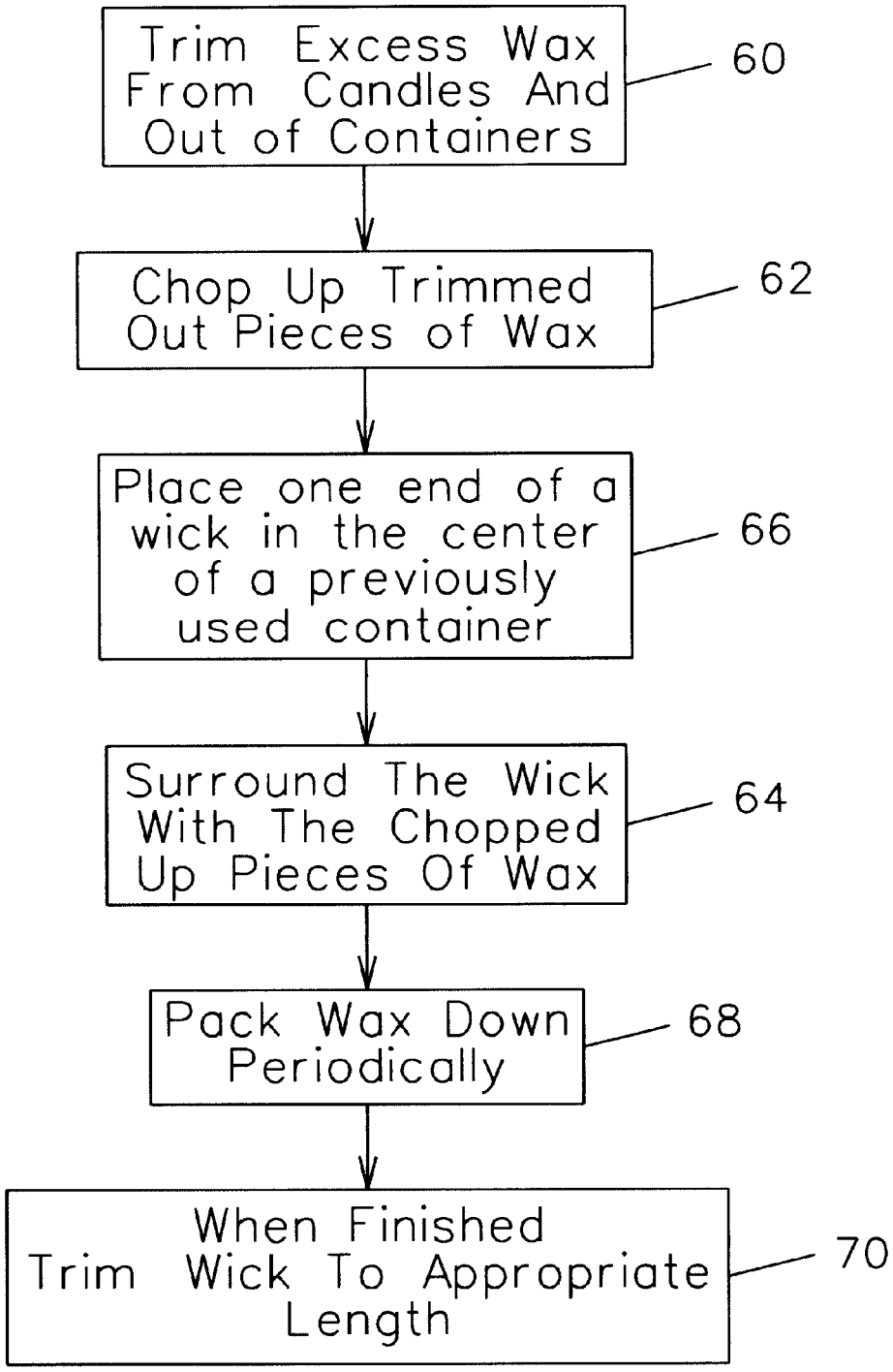
FIG. 5 is a flowchart illustrating the steps for using the candle forming kit to reuse previously used candle wax to form a new candle.

A plunger assembly 26 is mounted within the lid 14 for facilitating an up/down movement of the shaft 16. As best shown in FIGS. 4*a* and 4*b*, the plunger assembly 26 includes a housing 30 depending inwardly from the top surface of the lid 14. A lower end of a compression spring 28 is attached to a lower wall of the housing 30 and extends upwardly therein in a normally unbiased configuration (FIG. 4*a*). An opposed second end of the spring 28 is attached to a plate 32 that is slidably movable within the housing 30. This plate 32 is fixedly attached to the shaft 16 at approximately a midpoint between first 18 and second 20 ends thereof. Therefore, the spring is compressed or biased as the shaft 16 is moved downwardly (FIG. 4*b*) and returns to an unbiased configuration when the shaft 16 is moved upwardly (FIG. 4*a*). It is understood that the spring 28 is resilient and automatically returns to its normally unbiased configuration when the downward pressure is removed from the shaft 16.

The chopper assembly 10 further includes a handle member 34 having a cylindrical configuration with opposed first 35 and second 37 ends. Each end defines a threaded opening (FIG. 4*a*). The kit includes a pair of caps 38 having hemispherical tops and threaded plug ends 40 that are complementary to the threaded openings of the handle member 34. The handle member 34 defines an aperture 36 having threads complementary to those of the first end 18 of the shaft 16 for being selectively threadably coupled thereto.

When the handle member 34 is coupled to the first end 18 of the shaft 16, a downward pressure exerted by a user upon the handle member 34 causes the shaft 16 to move downwardly and the spring 28 to become compressed (FIG. 4*b*). This positions the chopper blades 22 adjacent the bottom wall 13 of the chopper assembly 10. An upward pressure on the handle member 34, or merely removing the downward pressure thereon, allows the spring 28 to resiliently move back to its unbiased configuration (FIG. 4*a*) and to correspondingly move the shaft 16 upwardly. This positions the chopper blades 22 substantially adjacent the lower end of the spring 28. Obviously, repeated up/down movement of the shaft 16 results in the chopping of wax deposited in the body portion 12 of the chopper assembly 10.

Figure 1:
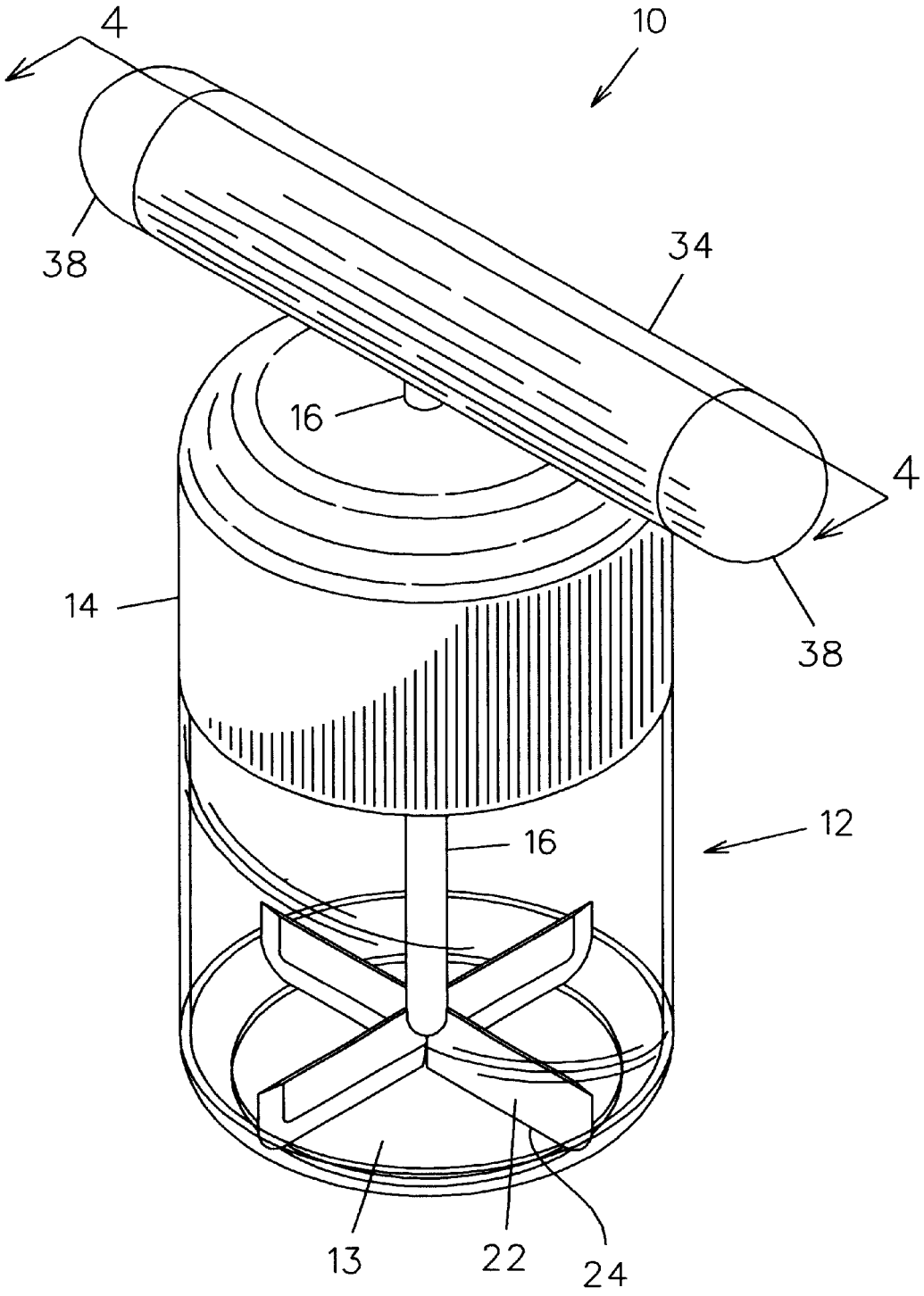
FIG. 1 is a perspective view of a chopper assembly according to a preferred embodiment of the present invention.
Figures 2A, 2B, 2C, 2D:
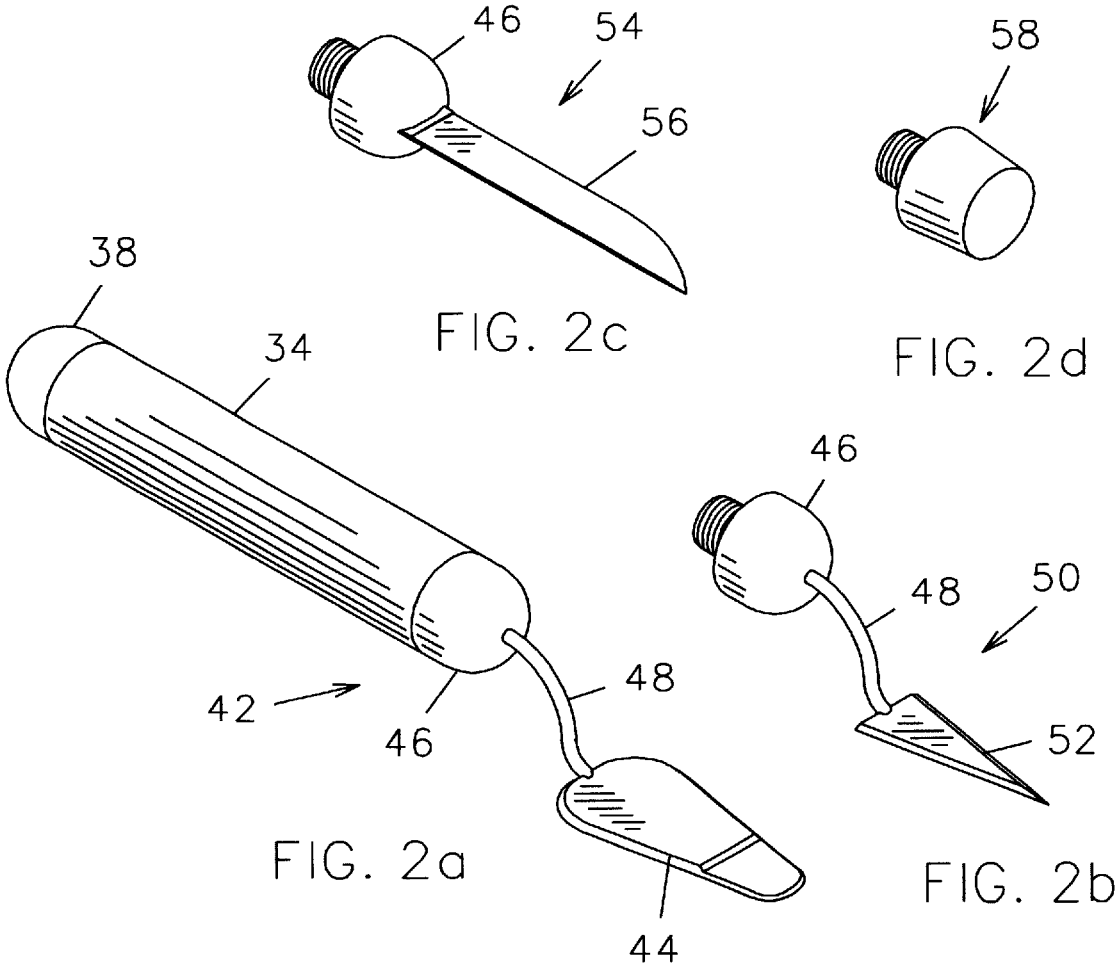
FIG. 2*a* is a perspective view of a spatula blade assembly coupled to a handle member of the chopper assembly.
FIG. 2*b* is a perspective view of an arrowhead blade assembly coupled to the handle member of the chopper assembly.
FIG. 2*c* is a perspective view of a knife blade assembly coupled to the handle member of the chopper assembly.
FIG. 2*d* is a perspective view of a tamping member coupled to the handle member of the chopper assembly.
Figure 3:
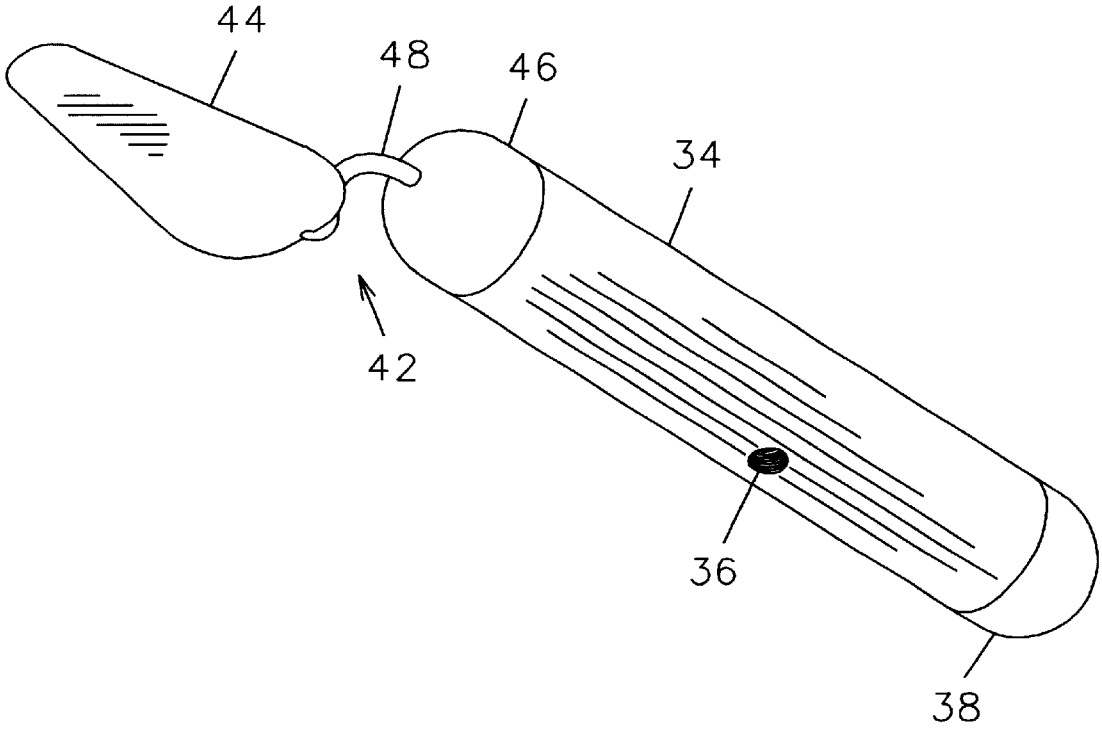
FIG. 3 is a bottom perspective view of the spatula blade assembly coupled to the handle member.

The kit further includes a plurality of blade assemblies, each assembly being particularly adapted to perform a specific wax manipulation function. A first blade assembly 42 includes a spatula blade 44 connected to a cap member 46 with a rod 48 (FIG. 2*a*). The cap member 46 is substantially similar to the cap 38 described previously and is adapted to be threadably coupled to either of the open ends of the handle member 34. The kit further includes a second blade assembly 50 having an arrowhead shaped blade 52 connected to a cap member 46 with a rod 48 (FIG. 2*b*). As the cap members and rods are of substantially similar construction, identical numbers have been used for their identification. Both the first 42 and second 50 blade assemblies are useful for prying or scraping wax from a previously used candle container. The kit also includes a third blade assembly 54 having a conventional knife blade 56 connected to a cap member 46 (FIG. 2*c*). This tool is especially useful for cutting large chunks of wax into pieces small enough to be deposited into the body portion 12 of the chopper assembly 10. The kit further includes a tamp member 58 connected to a cap member 46 with a rod (FIG. 2*d*). The tamp member 58 presents a blunt end useful for compacting finely chopped wax into a container so as to form a new candle.

In operation, the handle member 34 may be threadably removed from its attachment to the shaft 16. One or both of the caps 38 may then be removed from the handle member 34 so that the first 42 and/or second 50 blade assemblies may be coupled to ends thereof. The spatula and arrowhead blade assemblies may be used to extract unused wax from previously burned candles, as indicated at block 60 of FIG. 5. The third blade assembly 54 may then be coupled to the handle member 34 and used to cut large chunks of wax into pieces small enough to be deposited into the chopper assembly 10. By reattaching the handle member 34 to the shaft 16, a user may chop the wax portion into very small pieces or crumbs 62. Then, by removing the lid 14 and depositing the wax crumbs in a previously used container, a user may begin to form a new candle. Of course, a wick must be positioned centrally in the deposited wax 66. The tamp member 58 may be coupled to the handle member 34 and utilized to pack down the wax 68. Finally, the wick should be trimmed to an appropriate length 70.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A kit for forming candles, comprising:

a container having a generally cylindrical body portion with a closed bottom and an open top, said container including a lid releasably coupled to said body portion so as to cover said open top;

a shaft adapted to rotate about an imaginary vertical axis extending longitudinally through said container, said shaft having a first end extending through said lid and a second end having a plurality of chopper blades axially spaced thereabout and positioned within said container;

a plunger assembly mounted in said lid and coupled to said shaft for selectively moving said shaft between a first configuration in which said chopper blades are substantially adjacent said bottom wall and a second configuration in which said chopper blades are adjacent said plunger assembly, wherein said chopper blades are adapted to chop wax deposited in said container into smaller pieces upon movement of said shaft between said first and second configurations;

a cylindrical handle member releasably coupled to said first end of said shaft and defining a first open end, said plunger assembly operating to move said shaft between first and second configurations upon a user movement of said handle member; and a first blade assembly releasably coupled to said first open end of said handle member for manipulating wax material.

2. A candle forming kit as in claim 1 wherein said lid is threadably coupled to said body portion.

3. A candle forming kit as in claim 1 wherein said handle member includes a cylindrical configuration and is threadably coupled to said first end of said shaft and said first blade assembly is threadably coupled to said first open end of said handle member.

4. A candle forming kit as in claim 1 further comprising a cap adapted to be threadably coupled to said first open end of said handle.

5. A candle forming kit as in claim 1 wherein said body portion of said container is transparent.

6. A candle forming kit as in claim 1 wherein said plunger assembly comprises:

a housing extending inwardly from an upper surface of said lid, said housing having a plate slidably movable therein and attached to said shaft;

a compression spring positioned in said housing for moving said plate according to the bias of said spring, whereby said shaft is moved between said first and second configurations upon a movement of said spring between biased and unbiased configurations, respectively.

7. A candle forming kit as in claim 1 wherein each said chopper blade extends radially substantially between said shaft and said body portion of said container, each said blade having a sharpened lower edge.

8. A candle forming kit as in claim 1 wherein said first blade assembly includes a cap member and a spatula connected to said cap member with a rod, said cap member adapted to be releasably attached to said first open end of said handle member.

9. A candle forming kit as in claim 1 wherein said first blade assembly includes a cap member and an arrowhead blade connected to said cap member with a rod, said cap member adapted to be releasably attached to said first open of said handle member.

10. A candle forming kit as in claim 1 wherein said first blade assembly includes a cap member and a knife blade connected to said cap member with a rod, said cap member adapted to be releasably attached to said first open of said handle member.

11. A candle forming kit as in claim 1 wherein said handle member includes a cylindrical configuration having a second open end opposite said first open end, said kit further comprising a second blade assembly releasably coupled to said second open end of said handle member.

12. A kit for forming candles, comprising:

a container having a cylindrical side wall, a bottom wall and an open top;

a lid threadably coupled to said side wall so as to releasably cover said open top;

a shaft positioned in said container and adapted to rotate about an imaginary vertical axis extending longitudinally through said container, said shaft having a first end extending through said lid and a second end having a plurality of chopper blades axially spaced thereabout and positioned in said container;

a compression spring mounted in said lid and adapted to move between biased and unbiased configurations, said spring being coupled to said shaft for selectively moving said shaft between a first position when said spring is at said biased configuration in which said chopper blades are substantially adjacent said bottom wall and a second position when said spring is at said unbiased configuration in which said chopper blades are adjacent said spring, wherein said chopper blades are adapted to chop wax deposited in said container upon movement of said shaft between first and second positions;

a cylindrical handle member releasably coupled to said first end of said shaft and defining first and second longitudinally opposed open ends, said spring operating to move said shaft between said first and second positions upon a user movement of said handle member;

a first blade assembly releasably coupled to said first open end of said handle member and adapted to manipulate wax material; and a second blade assembly releasably coupled to said second open end of said handle member and adapted to manipulate wax material.

13. A candle forming kit as in claim 12 further comprising a first cap adapted to be releasably coupled to said first open end and a second cap adapted to be releasably coupled to said second open end.

14. A candle forming kit as in claim 12 wherein:

said first blade assembly includes a cap member and a spatula blade connected to said cap member with a rod, said cap member adapted to be releasably coupled to said first open end of said handle member;

said second blade assembly includes another cap member and, an arrowhead blade connected to said another cap member with a rod, said another cap member adapted to be releasably coupled to said second open end of said handle member.

15. A candle forming kit as in claim 12 wherein said first blade assembly includes a cap member and a knife blade connected to said cap member with a rod, said cap member adapted to be releasably coupled to said first open end of said handle member.

16. A candle forming kit as in claim 12 wherein said handle member is threadably coupled to said first end of said shaft.

17. A candle forming kit as in claim 12 wherein said side wall of said container is transparent.

18. A candle forming kit as in claim 12 wherein each said chopper blade extends radially substantially between said shaft and said body portion of said container, each said blade having a sharpened lower edge.

19. A candle forming kit as in claim 12 further comprising a tamping member adapted to be releasably coupled to said first end of said handle member.

* * * * *